US007562642B2

(12) United States Patent
Rabhi

(10) Patent No.: US 7,562,642 B2
(45) Date of Patent: Jul. 21, 2009

(54) ADJUSTMENT DEVICE FOR A VARIABLE COMPRESSION RATIO ENGINE

(76) Inventor: Vianney Rabhi, 14 Quai de Serbie, F-69006 Lyons (FR) F-69004

( * ) Notice: Subject to any disclaimer, the term of this patent is extended or adjusted under 35 U.S.C. 154(b) by 266 days.

(21) Appl. No.: 10/592,062

(22) PCT Filed: Mar. 11, 2005

(86) PCT No.: PCT/FR2005/000584

§ 371 (c)(1),
(2), (4) Date: Nov. 7, 2006

(87) PCT Pub. No.: WO2005/098219

PCT Pub. Date: Oct. 20, 2005

(65) Prior Publication Data

US 2008/0017023 A1 Jan. 24, 2008

Related U.S. Application Data

(60) Provisional application No. 60/624,185, filed on Nov. 3, 2004.

(30) Foreign Application Priority Data

Mar. 11, 2004 (FR) ..... 04 02540

(51) Int. Cl.
*F02D 15/02* (2006.01)
*F01B 9/02* (2006.01)

(52) U.S. Cl. ..... 123/48 B; 92/13.7; 92/133

(58) Field of Classification Search ..... 123/78 BA, 123/48 B, 197.1–4, 78 E, 78 F; 74/29, 30, 74/32

See application file for complete search history.

(56) References Cited

U.S. PATENT DOCUMENTS

| | | | | | |
|---|---|---|---|---|---|
| 1,885,298 | A | * | 11/1932 | Schell | 74/30 |
| 2,088,504 | A | * | 7/1937 | Brzezinski | 74/30 |
| 2,337,330 | A | * | 12/1943 | Julin | 74/29 |
| 3,633,552 | A | * | 1/1972 | Huber | 123/48 R |
| 4,498,430 | A | * | 2/1985 | Giuliani et al. | 123/53.1 |
| 4,738,230 | A | * | 4/1988 | Johnson | 123/48 B |
| 4,803,964 | A | * | 2/1989 | Kurek et al. | 123/197.4 |

(Continued)

FOREIGN PATENT DOCUMENTS

| | | |
|---|---|---|
| FR | 1 402 509 | 6/1965 |

(Continued)

*Primary Examiner*—Michael Cuff
*Assistant Examiner*—Hung Q Nguyen
(74) *Attorney, Agent, or Firm*—Young & Thompson

(57) ABSTRACT

An adjustment device for a variable compression ratio engine. An engine block (100) is equipped internally with a transmission device (1) including, for at least one piston (2), a transmission member (3) which co-operates with (i) a rolling guide device (4) and (ii) a sprocket wheel (5), the sprocket wheel (5) co-operating with a control rack (7), on the opposite side from the transmission member (3). Moreover, the vertical position of the control rack in relation to the engine block (100) is adjusted by a control device (12). In addition, the adjustment device includes: elements for adjusting the position of the transmission device (1), which are disposed at the rolling guide device (4); and elements for adjusting the working clearance of the transmission device (1), which are disposed at the control rack (7).

28 Claims, 9 Drawing Sheets

U.S. PATENT DOCUMENTS

| | | | | |
|---|---|---|---|---|
| 4,860,702 | A * | 8/1989 | Doundoulakis | 123/78 F |
| 5,572,959 | A * | 11/1996 | Hedelin | 123/48 C |
| 5,605,120 | A * | 2/1997 | Hedelin | 123/78 C |
| 5,673,665 | A * | 10/1997 | Kim | 123/197.1 |
| 5,934,243 | A * | 8/1999 | Kopystanski | 123/197.1 |
| 6,260,532 | B1 * | 7/2001 | Mendler | 123/192.2 |
| 6,354,252 | B1 | 3/2002 | Rabhi | |
| 6,397,722 | B1 * | 6/2002 | Eddington | 91/170 R |
| 6,450,136 | B1 * | 9/2002 | Klomp et al. | 123/78 E |
| 6,601,551 | B1 | 8/2003 | Rabhi | |
| 6,604,495 | B2 * | 8/2003 | Moteki | 123/48 B |
| 7,013,849 | B2 * | 3/2006 | Rabhi | 123/48 B |
| 2004/0144342 | A1 * | 7/2004 | Sieber et al. | 123/48 R |
| 2005/0016476 | A1 * | 1/2005 | Sakita | 123/78 F |

FOREIGN PATENT DOCUMENTS

| | | |
|---|---|---|
| GB | 221 477 | 2/1925 |
| WO | WO 03/008783 | 1/2003 |

* cited by examiner

ADJUSTMENT DEVICE FOR A VARIABLE COMPRESSION RATIO ENGINE

BACKGROUND OF THE INVENTION

The present invention relates to an adjustment device incorporated into an engine block making it possible to adjust the working clearances, and positioning of a transmission device of a variable compression ratio engine while giving it the angular freedoms necessary for it to work.

DESCRIPTION OF THE RELATED ART

Note that international patent WO98/51911 in the name of the applicant describes a device used to improve the overall efficiency of internal combustion piston engines used at variable load and speed by adapting their displacement and/or their compression ratio during operation.

The effective displacement of the engine is modified by forcing back into the inlet pipe cooled gases taken in excess into the cylinder and by controlling the length of stroke used to compress the gases via an additional variable closure delay inlet valve.

The effective compression ratio of the engine is adjusted by modifying the initial position of the stroke of a piston relative to a cylinder by means of a sprocket mounted free at the top end of a connecting rod, a transmission member fixedly attached to the piston and a control rack whose position is adjusted by a control device.

It is noted that, according to international patent WO00/31377 in the name of the applicant, the mechanical transmission device for a variable displacement engine comprises a piston fixedly attached in its lower portion to a transmission member interacting first with a rolling guide device and secondly with a sprocket fixedly attached to a connecting rod making it possible to transmit the movement between said piston and said connecting rod.

Note that, according to international patent WO03/008783 in the name of the applicant, the mechanical transmission device for a variable displacement engine comprises at least one cylinder in which there moves a piston that is fixedly attached, in its lower portion, to a transmission member interacting first by means of a small rack with a rolling guide device, and secondly by means of another large rack with a sprocket fixedly attached to a connecting rod, a control rack interacting with the sprocket, means of attaching the piston to the transmission member that provide a tightening prestress, connecting means that make it possible to stiffen the teeth of the racks, and means of reinforcing and lightening the structure of the sprocket.

SUMMARY OF THE INVENTION

Thus, the adjustment device according to the present invention is designed to adjust the working clearances and the positioning of a transmission device of a variable compression ratio engine while giving it the angular freedoms necessary for it to operate, the whole assembly being incorporated into an engine block.

The adjustment device according to the present invention comprises, at the rolling guide device, means of adjusting the positioning of the transmission device and, at the control rack, means of adjusting the working clearances of the transmission device.

The adjustment device according to the present invention comprises a control device comprising, at the thruster piston, a thruster for operating first means giving the transmission device the angular freedoms necessary for it to work.

The adjustment device according to the present invention comprises a control rack comprising second means giving the transmission device the angular freedoms necessary for it to work and acting more particularly between said control rack and the engine block.

The adjustment device according to the present invention comprises, at the rolling guide device, means of adjusting the positioning that consist of an orifice pierced in the engine block on the side of the cylinder and making it possible to insert into said block a support comprising racks providing the synchronization of the movement of a roller with that of the piston and a roller track interacting with said roller.

The adjustment device according to the present invention comprises a support that consists of a very thick plate which allows it to be attached to the engine block, from the outside of the latter, by means of screws.

The adjustment device according to the present invention comprises a body that is fitted to the support, said one body comprising roller tracks, and being attached to said support with at least one fastening screw.

The adjustment device according to the present invention comprises sealing between the support and the engine block that is provided by a seal housed in a groove made in the support.

The adjustment device according to the present invention comprises sealing between the support and the engine block that is provided by a seal housed in a groove made in the engine block.

The adjustment device according to the present invention comprises adjustment means consisting of a shim interposed between the inner face of the very thick plate and the outer face of the engine block.

The adjustment device according to the present invention comprises, at the control rack, means of adjusting the working clearances that consist of a bearing face whose distance relative to the engine block is adjustable.

The adjustment device according to the present invention comprises a flat face that is made on a cylindrical support screwed into the engine block.

The adjustment device according to the present invention comprises a cylindrical support that has a thread made on its periphery so that it can be screwed directly into a threaded orifice made in the engine block.

The adjustment device according to the present invention comprises a cylindrical support that comprises a tool socket allowing it to be tightened and held in position while it is immobilized by means of a locknut.

The adjustment device according to the invention comprises a locknut that comprises a tool socket allowing it to be tightened, the socket being designed so that it is possible to tighten the locknut while holding the cylindrical support by means of its tool socket.

The adjustment device according to the present invention comprises a cylindrical support that is fixedly attached to a very thick plate attached from the outside to the engine block by means of screws and whose distance relative to the engine block is adjusted by a shim placed between the very thick plate and the engine block.

The adjustment device according to the present invention comprises a thruster for controlling the control device that consists of an upper thruster rod having a threaded portion allowing it to be attached to the lower thruster rod of the control rack and a thruster piston traversed in its middle, by means of a bore, by the upper thruster rod, said upper thruster rod comprising centering means making it possible to center first the upper thruster rod on the thruster piston and secondly the lower thruster rod on the thruster piston.

The adjustment device according to the present invention comprises a thruster piston whose portion in contact with a thruster cylinder has a spherical profile forming a ball-and-socket type connection between said thruster piston and said thruster cylinder.

The adjustment device according to the present invention comprises a thruster piston that comprises seals on either side of its spherical profile.

The adjustment device according to the present invention comprises a thruster piston that comprises a release valve.

The adjustment device according to the present invention comprises a thruster piston that comprises a release valve consisting of a ball held on a seat, made in said thruster piston, by a spring.

The adjustment device according to the present invention comprises a control rack that comprises, on the side opposite to its teeth, a bearing face comprising a cavity in a portion of a sphere that is designed to receive a head, in a portion of a sphere, of a bearing piece housed in said cavity and producing a ball-and-socket connection between the control rack and the engine block.

The adjustment device according to the present invention comprises a control rack whose cavity has a housing at its pole, while the head comprises another housing at its pole, said housings making it possible to install a spring.

The adjustment device according to the present invention comprises a thruster piston that is traversed vertically by a bore for the passage of a control rod interacting, on either side of the thickness of the piston, with valves and springs.

The adjustment device according to the present invention comprises valves that are each traversed by the control rod and that press directly on the corresponding top or bottom face of the thruster piston.

The adjustment device according to the present invention comprises springs that are traversed by the control rod and that press first on the corresponding valve and secondly on a stop made on the control rod.

The adjustment device according to the present invention comprises valves that each comprise a seal that consists of a plastic, friction-resistant ring and an internal O-ring seal providing sealing between the ring and the body of the valve.

The adjustment device according to the present invention comprises valves that each have a small area of contact with the thruster piston, materialized by a circular peripheral rim designed to increase the pressure of contact exerted by said valves on said thruster piston.

The adjustment device according to the present invention comprises a thruster cylinder that is bored directly into the engine block and closed off in its upper portion by a cylinder head that is screwed onto the engine block.

BRIEF DESCRIPTION OF THE DRAWINGS

The following description with respect to the appended drawings, given as nonlimiting examples, will allow a better understanding of the invention, the features that it has and the advantages that it is likely to provide.

DESCRIPTION OF THE PREFERRED EMBODIMENTS

Figure 1:
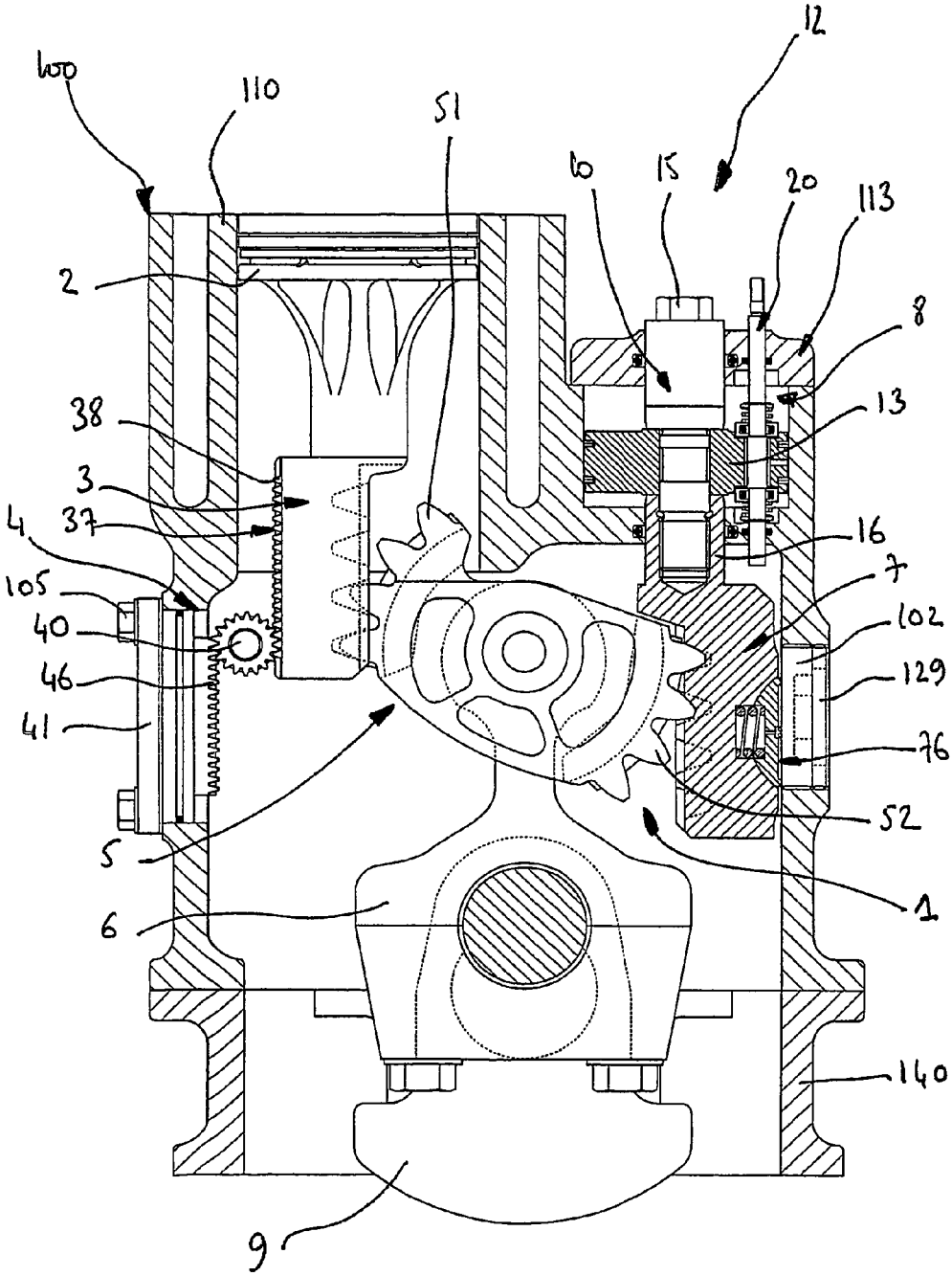
FIG. 1 is a view in section illustrating an adjustment device incorporated into an engine block allowing the adjustment of the working clearances, and of the positioning of a transmission device of a variable compression ratio engine while giving it the angular freedoms necessary for it to work.
Figure 2:
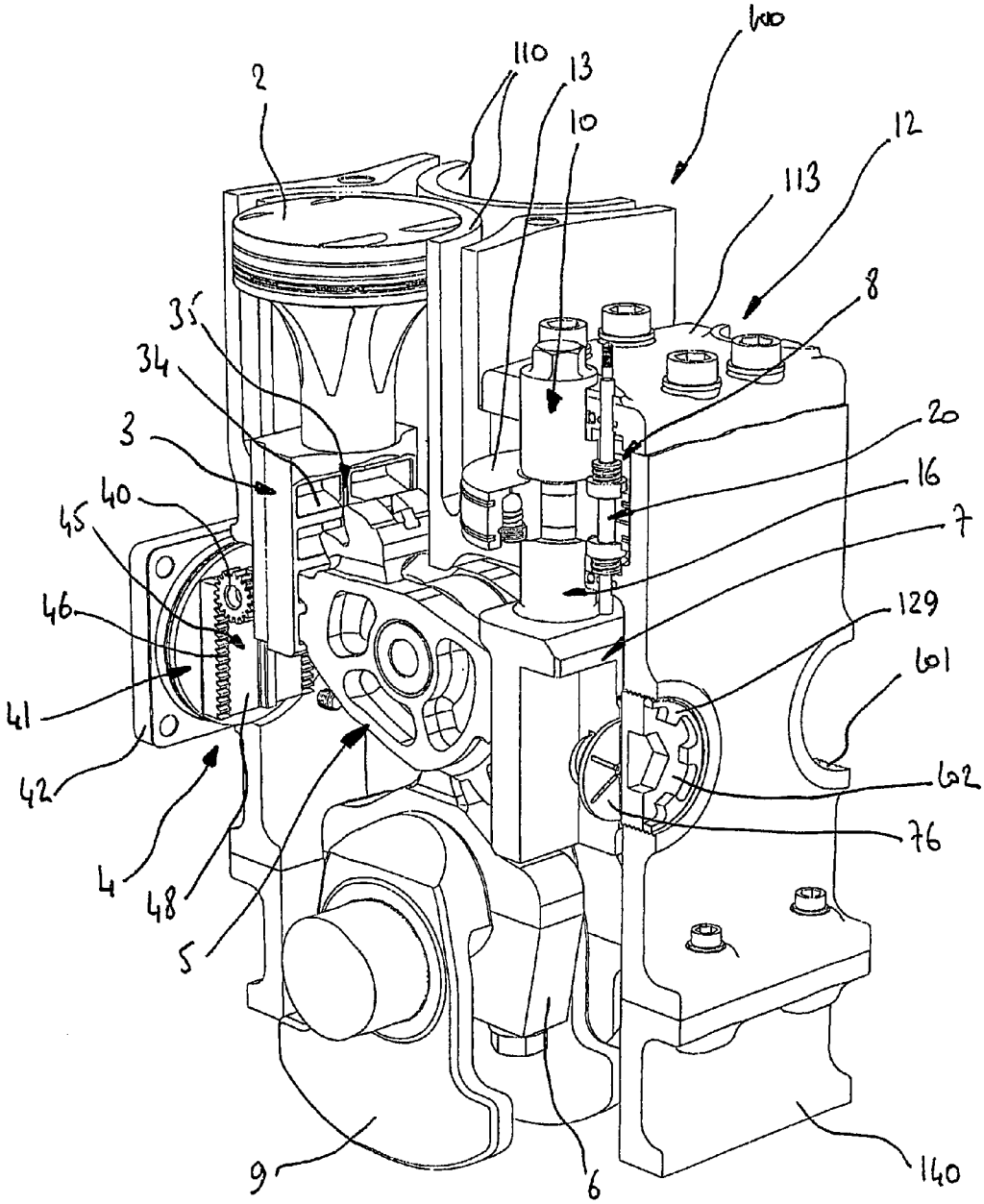
FIG. 2 is a view in perspective showing an adjustment device incorporated into an engine block allowing the adjustment of the working clearances, and of the positioning of a transmission device of a variable compression ratio engine while giving it the angular freedoms necessary for it to work.
Figure 3:
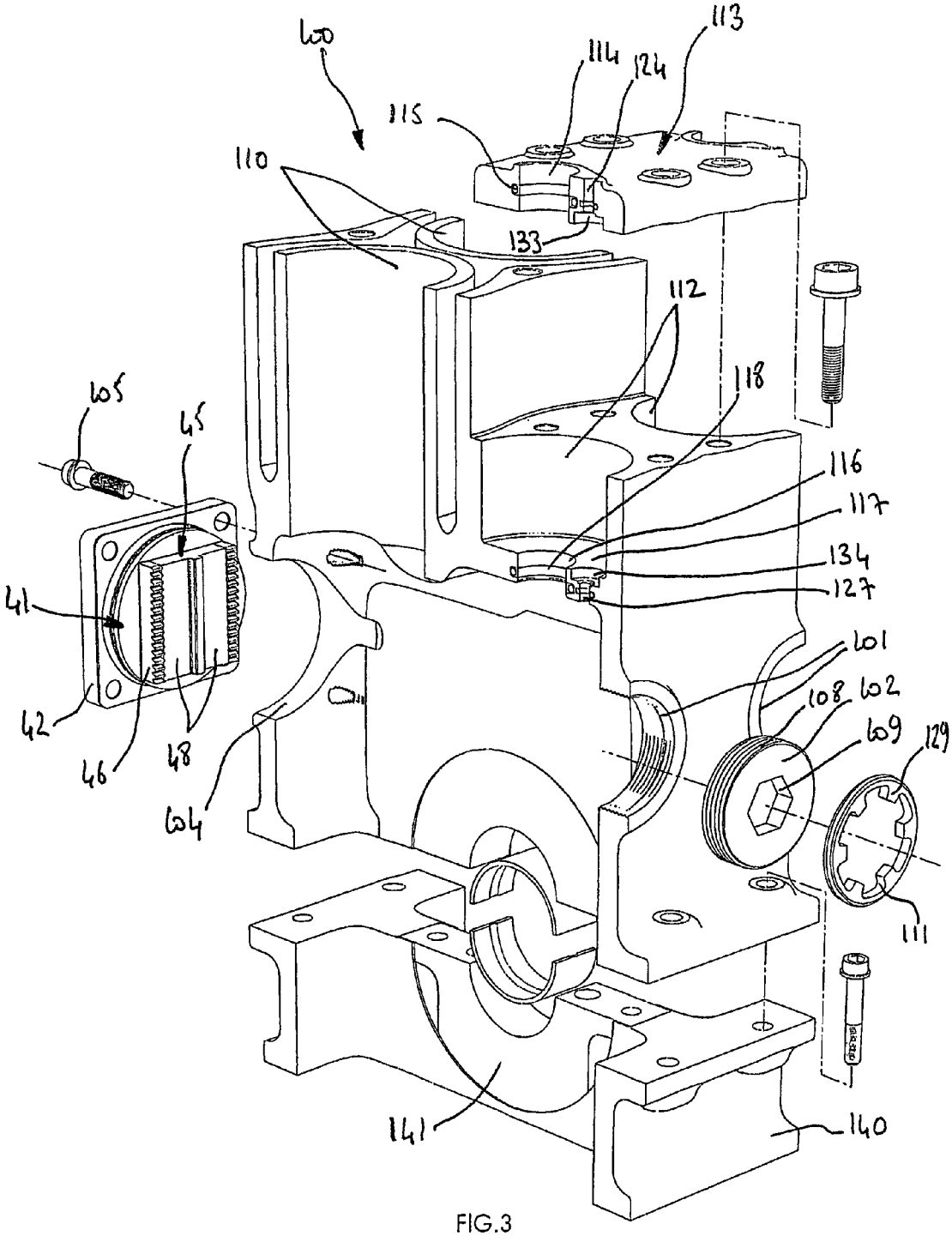
FIG. 3 is an exploded view in perspective representing the engine block into which the device for adjusting the mechanical transmission device according to the present invention is incorporated.

FIGS. 1 to 3 show an engine block 100 that comprises at least one cylinder 110 in which a piston 2 is moved by means of a transmission device 1.

The mechanical transmission device 1 comprises, in the lower portion of the piston 2, a transmission member 3 fixedly attached to said piston and interacting first with a rolling guide device 4 and secondly with a sprocket 5.

The sprocket 5 interacts with a connecting rod 6 connected to a crankshaft 9 in order to transmit the movement between said piston and said crankshaft.

The sprocket 5 interacts, on the side opposite to the transmission member 3, with another rack called the control rack 7 whose vertical position relative to the engine block 100 is controlled by a control device 12 comprising a control thruster 8, whose thruster piston 13 is guided in a thruster cylinder 112 made in the engine block 100.

The thruster cylinder 112 may be bored directly into the engine block 100, or in a liner not shown fitted into the engine block 100. The thruster cylinder 112 is closed in its upper portion by a thruster cylinder head 113 that is screwed onto the engine block 100. Provision may be made for one cylinder head 113 for each thruster cylinder 112 or a cylinder head 113 common to all the thruster cylinders 112 of a multi-cylinder engine.

The transmission device 1 comprises a transmission member 3 fixedly attached to the piston 2 and provided on one of its faces with a first large rack 35 whose teeth 34 interact with the teeth 51 of the sprocket 5.

The transmission member 3 comprises, on the side opposite to the rack 35, another rack 37 whose small teeth 38 interact with those of the roller 40 of the rolling guide device 4 fixedly attached to the engine block.

The engine block 100 is pierced with an orifice 104 on one side of the cylinder 110 making it possible to insert into said block a support 41 comprising racks 46 synchronizing the movement of the roller 40 with that of the piston 2 and a roller track 48 interacting with the roller 40.

The support 41 consists of a very thick plate 42 which allows it to be attached to the engine block 100, from the outside of the latter, by means of screws 105.

To make it easier to machine the racks 46 on the support 41, it is possible to fit onto said support 41 a body 45 comprising the roller track 48 interacting with the roller 40, said body being attached to said support 41 with at least one fastening screw 107.

The sealing between the support 41 and the engine block 100 is provided by a seal 47 housed in a groove 44 that may be made either in the support 41 or in the engine block 100.

The distance between the engine block 100 and the support 41 is adjusted by a shim 106 forming means of adjusting the position of the transmission device 1, said shim 106 being interposed between the inner face of the plate 42 and the outer face of the engine block 100.

The shim 106 makes it possible to adjust the control rack 7 in vertical position, taking account of the total dimensions of all the parts comprised between the bearing plane of the support 41 on the engine block 100 and the center of the thruster cylinder 112 of the control thruster 8.

The thickness of the shim 106 is determined after measuring the total dimensions of all the parts comprised between the bearing plane of the support 41 on the engine block 100 and the center of the thruster cylinder 112 of the control thruster 8.

Figure 4:
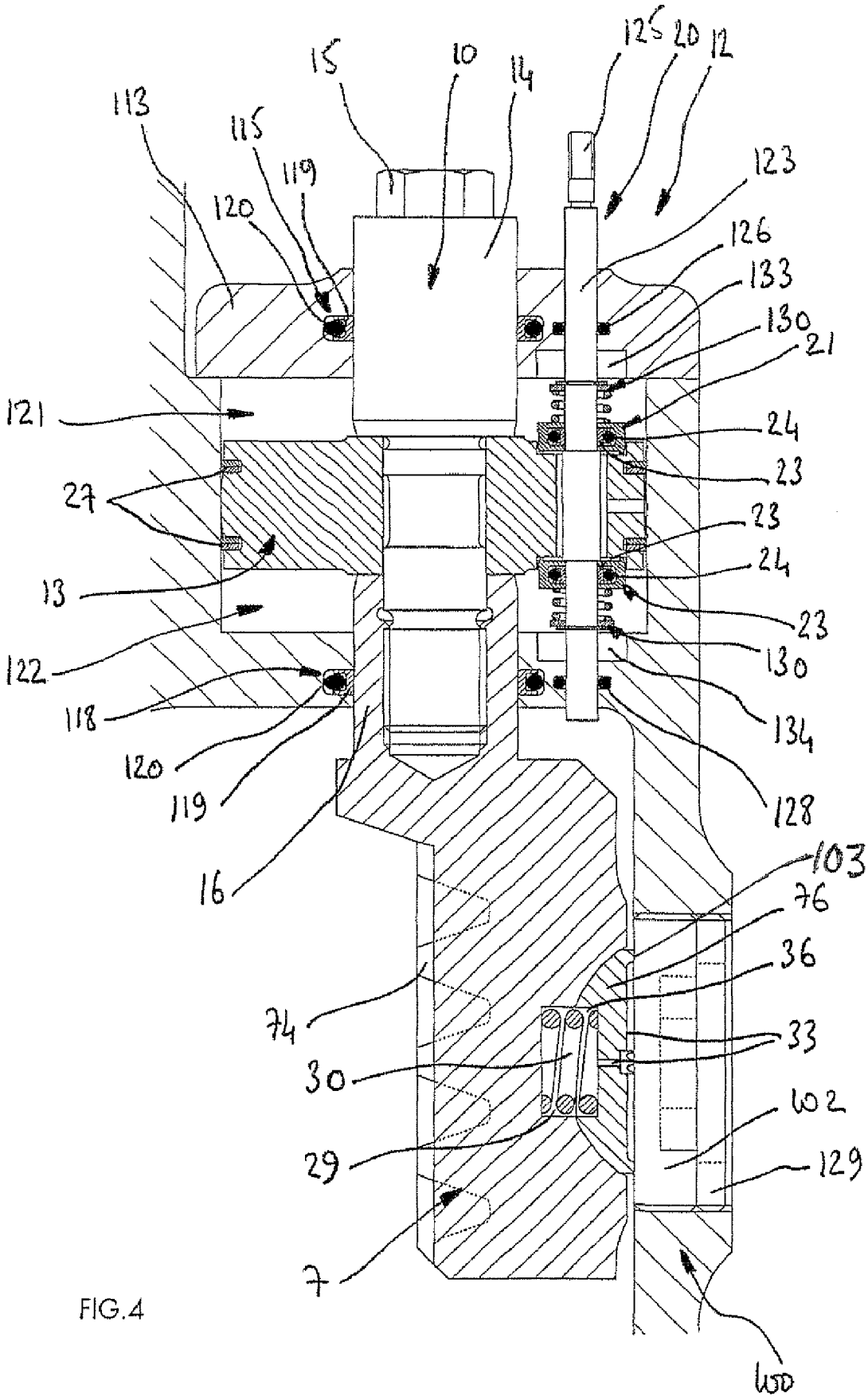
FIGS. 4 and 5 are views illustrating the adjustment device allowing the adjustment of the working clearances of a transmission device of a variable compression ratio engine while giving the angular freedoms necessary for it to work.
Figure 5:
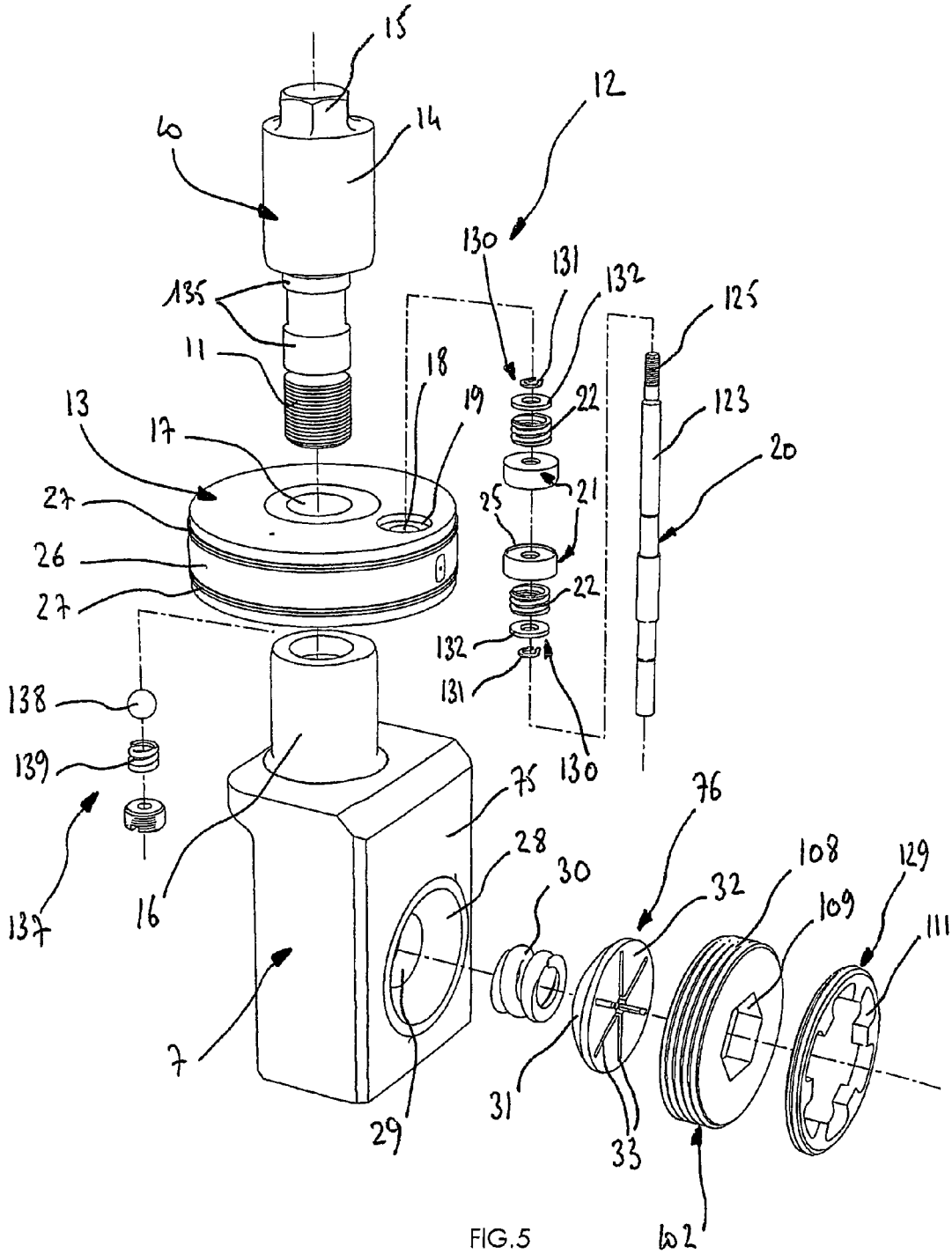
Figure 6:
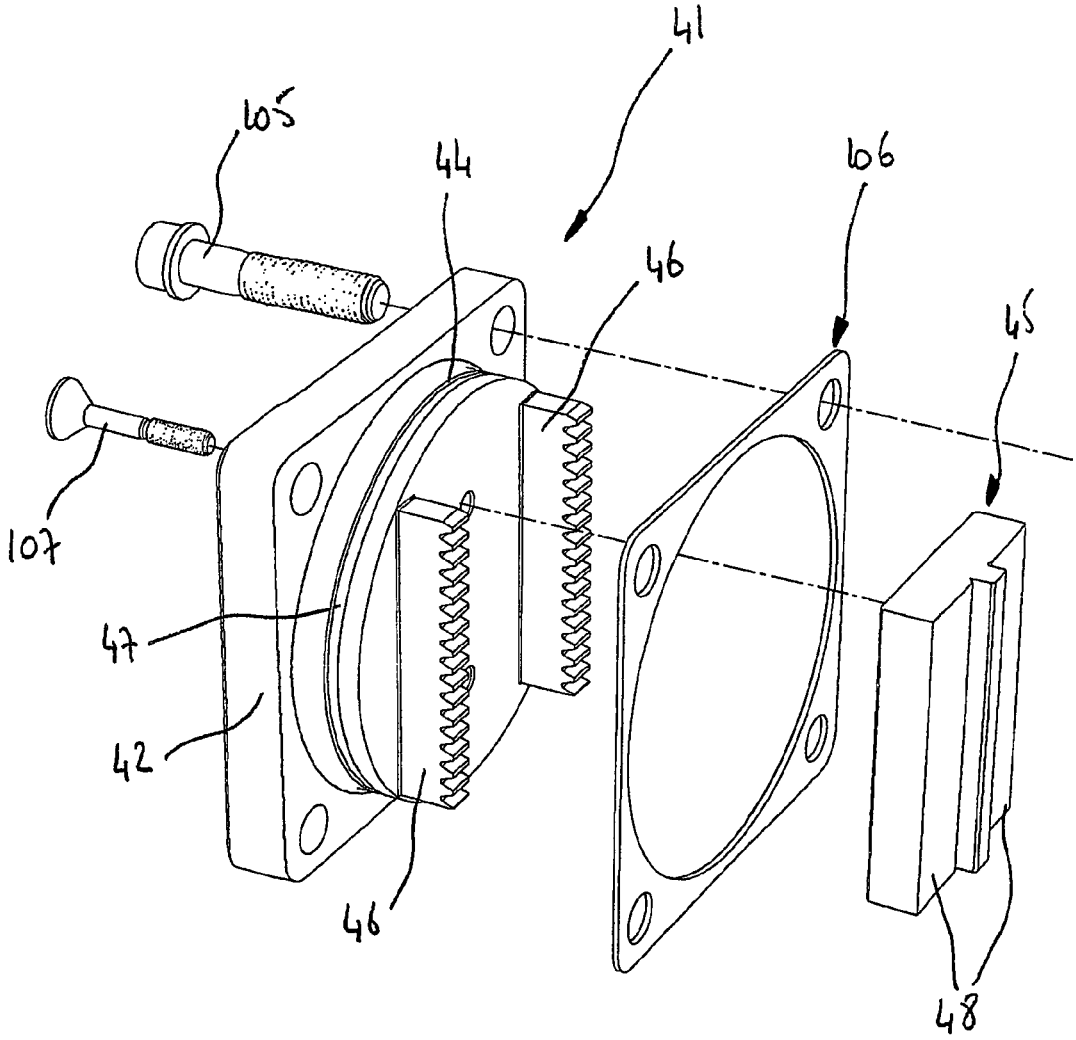
FIG. 6 is a view representing the device allowing the adjustment of the positioning of the transmission device according to the present invention.
Figure 7:
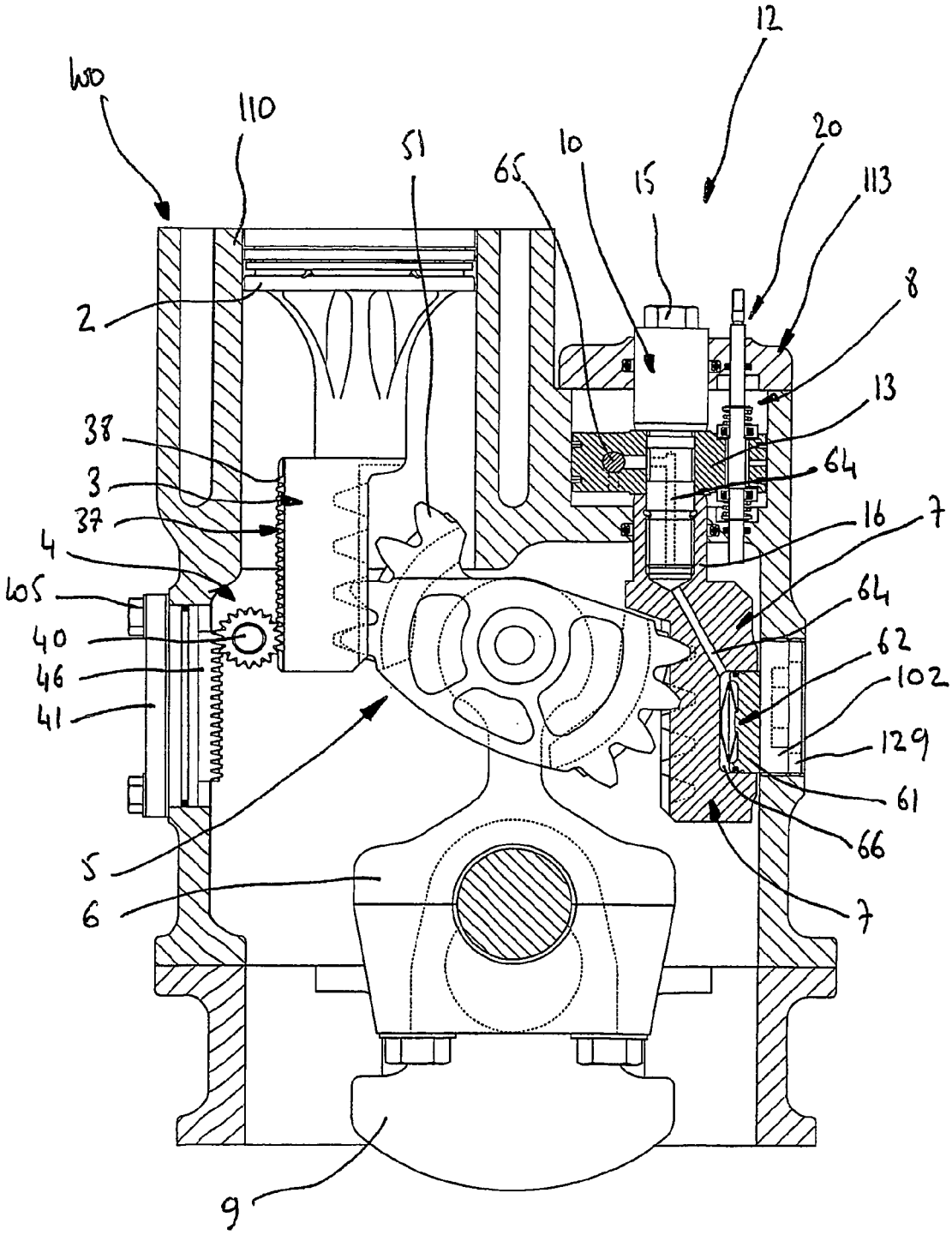
FIGS. 7 to 10 are views showing a variant of the adjustment device incorporated into an engine block allowing the adjustment of the working clearances, and of the positioning of a transmission device of a variable compression ratio engine while giving it the angular freedoms necessary for it to work.
Figure 8:
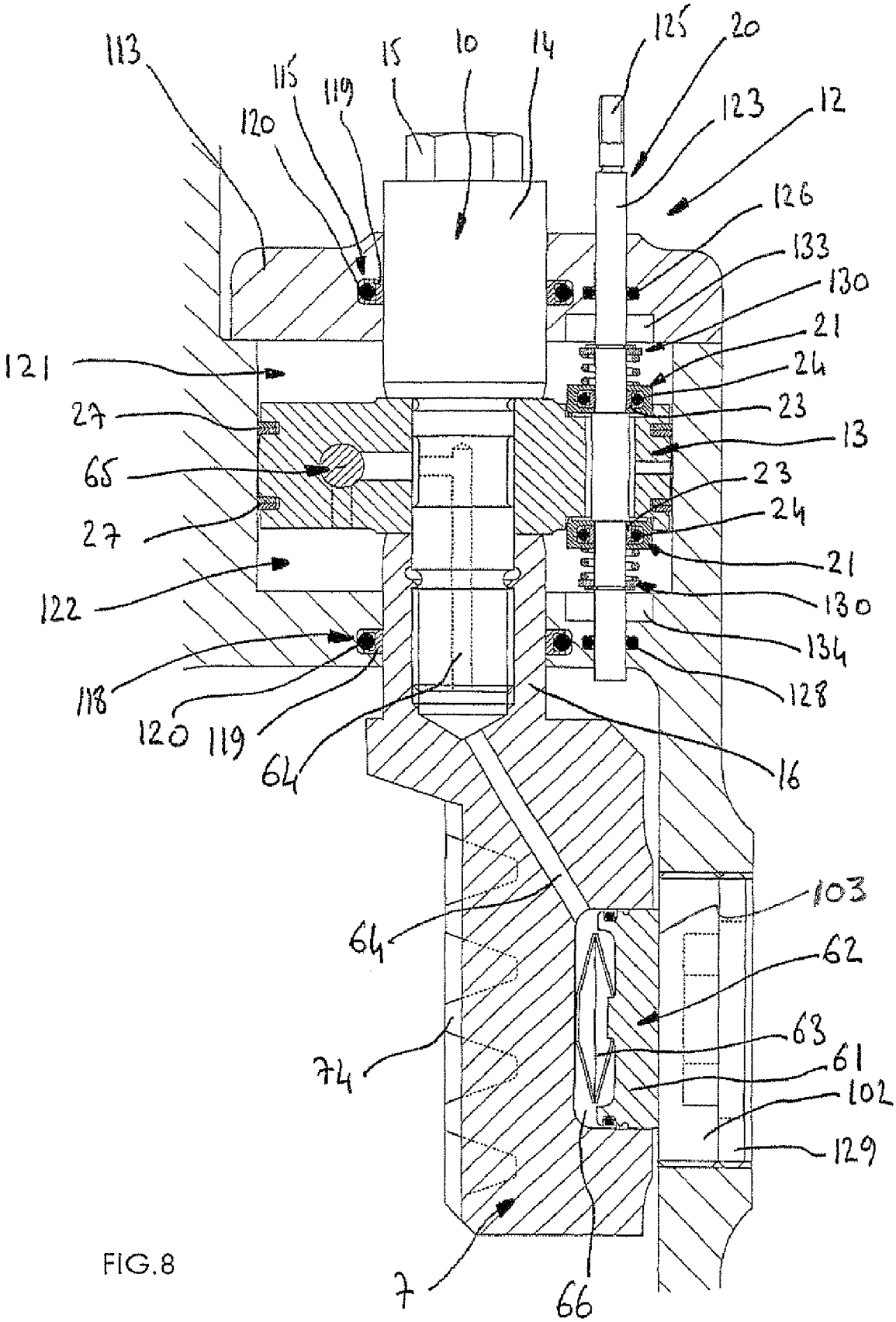
Figure 9:
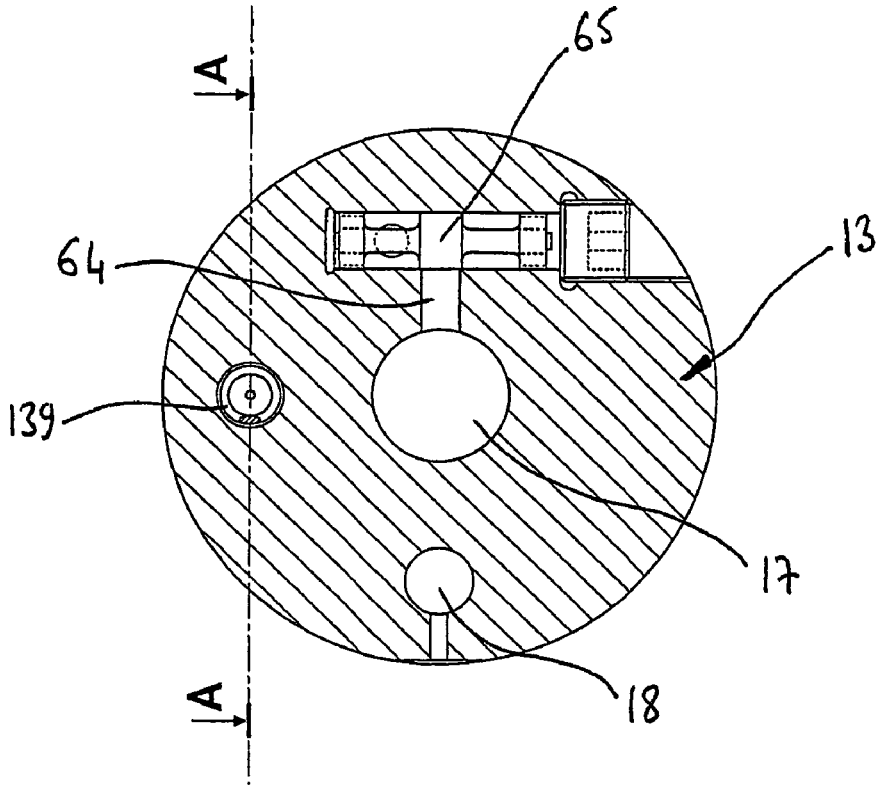

FIGS. 4 and 5 illustrate the control thruster 8 of the control device 12 that consists of an upper thruster rod 10 having a threaded portion 11 screwed into the lower thruster rod 16 of the control rack 7 and a thruster piston 13 traversed in its middle, by means of a bore 17, by the upper thruster rod 10.

The upper thruster rod 10 comprises a cylinder portion 14 interacting with a bore 114 made in the thruster cylinder head 113 providing the control thruster 8 with a ratio between displaced volume and stroke of thruster piston 13 that is identical for the upper chamber 121 and lower chamber 122.

The upper thruster rod 10 comprises a tool socket 15 allowing it to be tightened.

The upper thruster rod 10 comprises centering means 135 that make it possible to center first the upper thruster rod 10 on the thruster piston 13 and secondly the lower thruster rod 16 on the thruster piston 13.

According to a variant not shown, the lower thruster rod 16 may have a threaded portion screwed into the upper thruster rod 10, and centering means that make it possible to center first the upper thruster rod 10 on the thruster piston 13 and secondly the lower thruster rod 16 on the thruster piston 13.

The sealing between the upper thruster rod 10 and the bore 114 of the thruster cylinder head 113 is provided by a seal 115.

The sealing between the lower thruster rod 16 and a bore 116 made in the bottom 117 of the thruster cylinder 112 is provided by a seal 118.

The seals 115 and 118 are designed to be able to provide sealing while accommodating the large clearance provided between the upper thruster rod 10 and the lower thruster rod 16 and their respective bores 114, 116.

This arrangement allows the control rack 7 to orient itself in the engine block 100 so that the teeth 74 of said rack are aligned with the teeth 52 of the sprocket 5.

Each seal 115 and 118 consists, for example, of an external ring 119 made of friction-resistant plastic and an internal O-ring seal 120 which provides the sealing between the ring 119 and the corresponding bore 114, 116.

The thruster piston 13 is traversed vertically by another bore 18 which may or may not have at least one flat 19 making it possible to limit the bulk of the whole control device 12, for the passage of a control rod 20 interacting, on either side of the thickness of the piston 13, with valves 21 and springs 22.

Each valve 21 is traversed by the control rod 20 and presses directly on the corresponding top or bottom face of the thruster piston 13 or of the flat 19.

Each spring 22 is traversed by the control rod 20 and presses first on the corresponding valve 21 and secondly on a stop 130 made on the control rod 20 and consisting, for example, of an elastic ring 131 and a washer 132.

Each valve 21 comprises a seal that consists, for example, of a plastic, friction-resistant ring 23 and an inner O-ring seal 24 which provides the sealing between the ring 23 and the body of the valve 21.

The valves 21 may be designed in two parts to make it easier to install the seal that they comprise.

The clearance between the valves 21 and the control rod 20 is sufficient to allow the thruster piston 13 to pivot slightly in the thruster cylinder 112 so that the control rack 7 can orient itself in the engine block 100 so that the teeth 74 of said rack are aligned with the teeth 52 of the sprocket 5, while allowing said valves to provide the sealing between the upper chamber 121 and lower chamber 122 of the thruster cylinder 112.

The valves 21 may therefore pivot slightly relative to the control rod 20 so that they always remain in contact over their whole circumference with the thruster piston 13.

Each valve 21 may have a small area of contact with the thruster piston 13, materialized by a circular peripheral rim 25 designed to increase the pressure of contact exerted by said valves 21 on said thruster piston 13.

This arrangement first makes it possible to provide better sealing and secondly allows the valves 21 to provide a larger surface area exposed to the pressure of the fluid on the side of the thruster piston 13 in order to make control of the control device 12 easier.

The control rod 20 comprises, for its guidance, a cylindrical portion 123 interacting with a bore 124 made in the thruster cylinder head 113. The control rod 20 comprises, in the extension of its cylindrical portion 123, a threaded end 125 allowing it to be attached to a control device not shown.

The sealing between the control rod 20 and the bore 124 of the thruster cylinder head 113 is provided by a seal 126.

The bore 124 may comprise a flat 133 in which may move the spring 22 and the stop 130 that are in the upper thruster chamber 121, in order to limit the vertical bulk of the control device 12.

On the opposite side of the thruster cylinder head 113, the control rod 20 is guided in a bore 127 made in the bottom 117 of the thruster cylinder 112.

The sealing between the control rod 20 and the bore 127 of the thruster cylinder 112 is provided by a seal 128.

The bore 127 may comprise a flat 134 in which may move the spring 22 and the stop 130 that are in the lower thruster chamber 122, in order to limit the vertical bulk of the control device 12.

The portion of the thruster piston 13 in contact with the thruster cylinder 112 has a spherical profile 26 forming a ball-and-socket type connection between said thruster piston 13 and said thruster cylinder 112.

This arrangement is designed to allow the control rack 7 to pivot so that its teeth 74 can be aligned with the teeth 52 of the sprocket 5.

The thruster piston 13 comprises seals 27 on either side of its spherical profile 26.

The seals 27 are designed to provide the sealing between the upper chamber 121 and lower chamber 122 of the control thruster 8, despite the large clearances necessary for the orientation of the thruster piston 13 in the thruster cylinder 112.

In a variant not shown, the seals 27 consist, for example, of an external ring made of friction-resistant plastic and an internal O-ring seal which provides the sealing between the ring and the thruster piston 13.

Thus, the spherical profile 26 of the thruster piston 13 forms first means giving the angular freedoms necessary for the transmission device 1 to work.

Figure 10:
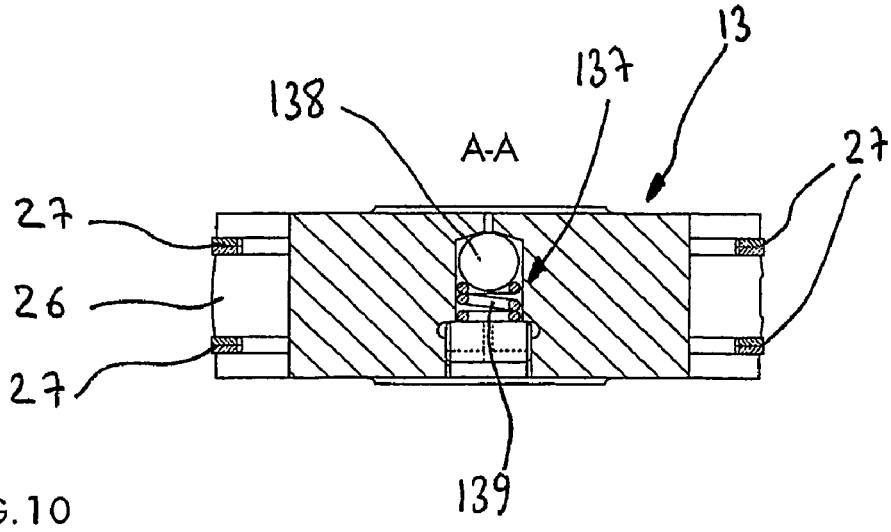

The thruster piston 13 may comprise a release valve 137 that may consist, for example, of a ball 138 held, on a seat made in the thruster piston 13, by a spring 139 (FIG. 10).

The release valve 137 makes it possible to limit the maximum pressure of the upper chamber 121 of the control thruster 8 and consequently makes it possible to limit the maximum force exerted on the teeth 34, 51, 52, 74 of the transmission device 1.

The control rack 7 comprises on the side opposite to its teeth 74, a bearing face 75 interacting with a bearing face 103 made in the engine block 100 and whose distance relative to said engine block 100 is adjustable, this forming means of adjusting the working clearances of the transmission device 1.

The bearing face 75 comprises a cavity 28 in a portion of a sphere which may or may not have at its pole a cylindrical housing 29 for a spring 30 which may, for example, be of the helical or "belleville" type.

The function of the spring 30 is to keep the various members of the transmission device 1 in contact when a slight force is exerted on the teeth 51, 52 of the sprocket 5.

The cavity 28 is designed to receive the head 31 in a portion of a sphere of a bearing piece 76 housed in said cavity producing a ball-and-socket connection between the control rack 7 and the engine block 100 (FIG. 5).

The head in a portion of a sphere 31 of the bearing piece 76 may have at its pole a cylindrical housing 36 for the spring 30.

The bearing piece 76 comprises, on the side opposite to its head in a portion of a sphere 31, a flat face 32 interacting with the bearing face 103 made in the engine block 100.

This arrangement allows the control rack 7 to move relative to the engine block 100.

The bearing piece 76 may comprise a network of ducts 33 making it possible to deliver the lubricating oil first to its flat face 32 and secondly to its head in a portion of a sphere 31.

Thus, the ball-and-socket type connection between the control rack 7 and the engine block 100 formed by the spherical profile of the cavity 28 of said control rack 7 and by the head in a portion of a sphere 31 of the bearing piece 76 forms second means giving the angular freedoms necessary for the transmission device 1 to work.

The bearing face 103 of the engine block 100 is made, for example, on a cylindrical support 102 screwed into said block.

The cylindrical support 102 has a thread 108 made on its periphery in order to be screwed directly into a threaded orifice 101 made in the engine block 100.

The cylindrical support 102 comprises a tool socket 109 allowing it to be tightened and held in position while it is immobilized by means of a locknut 129.

The locknut 129 comprises a tool socket 111 allowing it to be tightened. The tool socket 111 is designed so that it is possible to tighten the locknut 129 while holding the cylindrical support 102 by means of its tool socket 109.

Thus, the cylindrical support 102 and its locknut 129 screwed into the threaded orifice 101 of the engine block 100 form a device for adjusting the working clearances of the transmission device 1 in the engine block 100.

As a variant, the cylindrical support 102 may be fixedly attached to a very thick plate, not shown, attached from the outside to the engine block 100 by means of screws.

For this variant, the working clearances of the transmission device 1 in the engine block 100 are adjusted by means of a shim, not shown.

This shim, placed between the very thick plate and the engine block 100 makes it possible to adjust the distance between said plate and said engine block.

According to a variant, not shown, the cavity 28 in a portion of a sphere used as a housing for the head 31 in a portion of a sphere of the bearing piece 76 may be made in the cylindrical support 102.

In this variant, the flat face 32 of the bearing piece 76 slides on a flat face made on the control rack 7, that is to say, the opposite of what has been previously described, without, for all that, changing the object of the present invention.

FIGS. 7 to 10 show a variant embodiment of the second means giving the angular freedoms necessary for the transmission device to work provided at the control rack 7 and more particularly at its ball-and-socket type connection pressing on the engine block 100.

In this variant, the second means consist of a pressure thruster 62 whose piston 61, thanks to a spherical profile, makes a ball-and-socket type connection between the control rack 7 and the engine block 100.

A directional flow valve 65 makes it possible to permanently compare the pressures existing in the upper chamber 121 and the lower chamber 122 in order to connect the one with the higher pressure to the chamber 66 of the pressure thruster 62.

Thus, the directional flow valve 65 makes it possible to connect the upper chamber 121 or the lower chamber 122 whose pressure is the higher with the chamber 66 of the pressure thruster 62.

The pressure thruster 62 comprises a spring 63 which makes it possible to keep the various members of the transmission device 1 in contact when the pressure existing in the chamber 66 is low.

The spring 63 may be of the helical or "belleville" type.

As an example, the directional control valve 65 may be housed in the thickness of the thruster piston 13. In this case, it is connected to the pressure thruster 62 via ducts 64 made in the thruster piston 13, the upper thruster rod 10 and lower thruster rod 16 and in the control rack 7.

Note that the engine block 100 may be made of steel, cast iron or light alloy. It may comprise one or more dry or wet liners. It may also comprise one or more cylinders 110, directly bored into said engine block 100.

The engine block 100 may comprise at least one duct and/or at least one chamber in which an engine-cooling fluid circulates.

The engine block 100 may comprise at least one duct and/or at least one chamber in which there circulates a fluid for lubricating the various engine components.

Note that the engine block 100 comprises bearing caps 141 attached via at least two screws, said bearing caps 141 being able to be incorporated into a bearing casing 140.

Note that the engine block 100 may comprise balance shafts to limit the effect of the vibrations, said balance shafts being able to be mounted in an independent casing attached to the engine block 100. The engine block 100 may comprise a lubricant casing made either of pressed metal sheeting or of light alloy or of plastic, which may or may not comprise reinforcing structures.

It should furthermore be understood that the foregoing description has been given only as an example and that it in no way limits the field of the invention which would not be departed from by replacing the described embodiment details with any other equivalent.

The invention claimed is:

1. An adjustment device for a variable compression ratio engine, comprising:

a control rack (7);

a control device (12) providing adjustment of a vertical position of the control rack relative to an engine block (100);

a rolling guide device (4);

a sprocket (5);

a transmission device (1) for at least one piston (2), said transmission device comprising a transmission member (3) interacting first with the rolling guide device (4), and secondly with the sprocket (5), said sprocket (5) interacting on an opposite side from the transmission member (3) with the control rack (7); and an adjustment device comprising i) at the rolling guide device (4), a position adjustment means for adjusting the positioning of the transmission device (1), and ii) at the control rack (7), a clearance adjustment means for adjusting the working clearances of the transmission device (1).

2. The adjustment device as claimed in claim 1, wherein the control device (12) comprises:

a thruster piston (13); and at the thruster piston (13), a thruster (8) for operating a first means giving the transmission device (1) angular freedoms necessary for working.

3. The adjustment device as claimed in claim 1, wherein the control rack (7) comprises:

a second means giving the transmission device (1) angular freedoms necessary for working and acting between said control rack (7) and the engine block (100).

4. The adjustment device as claimed in claim 1, wherein, at the rolling guide device (4), the position adjustment means comprises:

a support insertable on an orifice (104) of the engine block (100) on a side of the cylinder (110); and a roller (40); and a roller track (48) interacting with said roller (40), the support (41) comprising racks (46) providing the synchronization of movement of the roller (40) with movement of the piston (2) and the roller track (48) interacting with said roller (40).

5. The adjustment device as claimed in claim 4, wherein the support (41) comprises a plate (42) attachable to the engine block (100), from the outside of the engine block, by means of screws (105).

6. The adjustment device as claimed in claim 4, further comprising:

a body (45) fitted to the support (41), said body (45) comprising the roller track (48) interacting with the roller (40), and being attached to said support (41) with at least one fastening screw (107).

7. The adjustment device as claimed in claim 4, wherein sealing between the support (41) and the engine block (100) is provided by a seal (47) housed in a groove (44) made in the support (41).

8. The adjustment device as claimed in claim 4, wherein sealing between the support (41) and the engine block (100) is provided by a seal (47) housed in a groove (44) made in the engine block (100).

9. The adjustment device as claimed in claim 4, wherein the position adjustment means comprises a shim (106) interposed between an inner face of the plate (42) and an outer face of the engine block (100).

10. The adjustment device as claimed in claim 1, wherein, at the control rack (7) and on the engine block (100), the clearance adjustment means comprises a bearing face (103) whose distance relative to the engine block (100) is adjustable.

11. The adjustment device as claimed in claim 10, wherein the bearing face (103) is located on a support (102) screwable into the engine block (100).

12. The adjustment device as claimed in claim 11, wherein the support (102) has a thread (108) made on a periphery of the support (102) so that the support (102) can be screwed directly into a threaded orifice (101) made in the engine block (100).

13. The adjustment device as claimed in claim 11, wherein the support (102) comprises a tool socket (109) allowing the support to be tightened and held in position while immobilized by means of a locknut (129).

14. The adjustment device as claimed in claim 13, wherein the locknut (129) comprises a tool socket (111) allowing the locknut to be tightened, the socket being designed for tightening the locknut (129) while holding the support (102) by means of the tool socket (109).

15. The adjustment device as claimed in claim 10, wherein the bearing face (103) is made on a support (102) fixedly attached to a plate that is attached from the outside to the engine block (100) by means of screws and whose distance relative to the engine block (100) is adjusted by a shim placed between the plate and said engine block (100).

16. The adjustment device as claimed in claim 2, wherein the control thruster (8) of the control device (12) comprises an upper thruster rod (10) having a threaded portion (11) for attachment to a lower thruster rod (16) of the control rack (7) and a thruster piston (13) traversed, by means of a bore (17), by the upper thruster rod (10), said upper thruster rod (10) comprising centering means (135) to center first the upper thruster rod (10) on the thruster piston (13) and secondly the lower thruster rod (16) on the thruster piston (13).

17. The adjustment device as claimed in claim 2, wherein a portion of the thruster piston (13) in contact with a thruster cylinder (112) has a spherical profile (26) forming a ball-and-socket connection between said thruster piston (13) and said thruster cylinder (112).

18. The adjustment device as claimed in claim 17, wherein the thruster piston (13) has a spherical profile (26) and comprises seals (27) on either side of the spherical profile (26).

19. The adjustment device as claimed in claim 2, wherein the thruster piston (13) comprises a release valve (137).

20. The adjustment device as claimed in claim 19, wherein the thruster piston (13) comprises the release valve (137) which comprises a ball (138) held on a seat, made in said thruster piston (13), by a spring (139).

21. The adjustment device as claimed in claim 13, wherein the control rack (7) comprises teeth (74), and, on a side opposite to the teeth (74), a bearing face (75) comprising a cavity (28) in a portion of a sphere that is designed to receive a head (31), in a portion of a sphere, of a bearing piece (76) housed in said cavity (28) and producing a ball-and-socket connection between the control rack (7) and the engine block (100).

22. The adjustment device as claimed in claim 21, wherein the cavity (28) has a pole and a housing (29) at the pole, while the head (31) comprises another housing (36) at the pole, said housings allowing installation of a spring (30).

23. The adjustment device as claimed in claim 2, wherein the thruster piston (13) is traversed vertically by a bore (18) for passage of a control rod (20) interacting, on either side of a thickness of the thruster piston (13), with valves (21) and springs (22).

24. The adjustment device as claimed in claim 23, wherein each valve (21) is traversed by the control rod (20) and presses directly on the corresponding top or bottom face of the thruster piston (13).

25. The adjustment device as claimed in claim 23, wherein each spring (22) is traversed by the control rod (20) and presses first on the corresponding valve (21) and secondly on a stop made on the control rod (20)

26. The adjustment device as claimed in claim 23, wherein each valve (21) comprises a seal that comprises a plastic, friction-resistant ring (23) and an internal O-ring seal (24) providing sealing between the ring (23) and the body of the valve (21).

27. The adjustment device as claimed in claim 23, wherein each valve (21) has an area of contact with the thruster piston (13), materialized by a circular peripheral rim (25) designed to increase the pressure of contact exerted by said valves (21) on said thruster piston (13).

28. The adjustment device as claimed in claim 17, wherein the thruster cylinder (112) is in the form of a bore in the engine block (100) and closed off in an upper portion by a cylinder head (113) of the engine block (100).

* * * * *